US008536854B2

(12) United States Patent
Melanson et al.

(10) Patent No.: US 8,536,854 B2
(45) Date of Patent: Sep. 17, 2013

(54) SUPPLY INVARIANT BANDGAP REFERENCE SYSTEM

(75) Inventors: John L. Melanson, Austin, TX (US); Prashanth Drakshapalli, Austin, TX (US); Larry L. Harris, Austin, TX (US)

(73) Assignee: Cirrus Logic, Inc., Austin, TX (US)

( * ) Notice: Subject to any disclaimer, the term of this patent is extended or adjusted under 35 U.S.C. 154(b) by 350 days.

(21) Appl. No.: 12/894,472

(22) Filed: Sep. 30, 2010

(65) Prior Publication Data

US 2012/0081099 A1 Apr. 5, 2012

(51) Int. Cl.
*G05F 3/28* (2006.01)

(52) U.S. Cl.
USPC ..... 323/316; 323/313; 327/539

(58) Field of Classification Search
USPC ..... 323/313–316; 327/539
See application file for complete search history.

(56) References Cited

U.S. PATENT DOCUMENTS

| | | | | |
|---|---|---|---|---|
| 5,774,013 | A * | 6/1998 | Groe | 327/543 |
| 6,058,033 | A * | 5/2000 | Williams et al. | 363/73 |
| 7,122,997 | B1 * | 10/2006 | Werking | 323/313 |
| 7,224,210 | B2 * | 5/2007 | Garlapati et al. | 327/539 |
| 7,486,065 | B2 * | 2/2009 | Lin et al. | 323/313 |
| 7,880,534 | B2 * | 2/2011 | Huang et al. | 327/539 |
| 2006/0001413 | A1 * | 1/2006 | Marinca | 323/315 |
| 2008/0180161 | A1 * | 7/2008 | Jo et al. | 327/513 |
| 2008/0265860 | A1 * | 10/2008 | Dempsey et al. | 323/314 |
| 2009/0284304 | A1 * | 11/2009 | Conte et al. | 327/513 |
| 2010/0148857 | A1 * | 6/2010 | Chellappa | 327/538 |
| 2010/0156389 | A1 * | 6/2010 | Oswal et al. | 323/316 |
| 2011/0074495 | A1 * | 3/2011 | Duval et al. | 327/539 |

OTHER PUBLICATIONS

Michejda, John, et al.: "A Precision CMOS Bandgap Reference" Reprinted from IEEE J. Solid-State Circuits, vol. SC-19, No. 6, pp. 1014-1021, Dec. 1984, pp. 34-41.

* cited by examiner

*Primary Examiner* — Adolf Berhane
*Assistant Examiner* — Fred E Finch, III
(74) *Attorney, Agent, or Firm* — Terrile, Cannatti, Chambers & Holland LLP; Kent B. Chambers

(57) ABSTRACT

An electronic reference-signal generation system includes a supply invariant bandgap reference system that generates one or more bandgap reference signals that are substantially unaffected by bulk error currents. In at least one embodiment, the bandgap reference generates a substantially invariant bandgap reference signals for a range of direct current (DC) supply voltages. Additionally, in at least one embodiment, the bandgap reference system provides substantially invariant bandgap reference signals when the supply voltage varies due to alternating current (AC) voltages. In at least one embodiment, the bandgap reference system generates a bandgap reference voltage VBG, a "proportional to absolute temperature" (PTAT) current ("$i_{PTAT}$") and a "zero dependency on absolute temperature" (ZTAT) current ("$i_{ZTAT}$") that are substantially unaffected by variations in the supply voltage and unaffected by a bulk error current.

32 Claims, 7 Drawing Sheets

SUPPLY INVARIANT BANDGAP REFERENCE SYSTEM

CROSS-REFERENCE TO RELATED APPLICATION

This application claims priority under 35 U.S.C. §119(e) to U.S. Provisional Application No. 61/306,638, filed Feb. 22, 2010.

BACKGROUND OF THE INVENTION

1. Field of the Invention

The present invention relates in general to the field of electronics, and more specifically to a supply invariant bandgap reference system.

2. Description of the Related Art

Electronic systems represent a wide range of systems including controllers for switching power converters, microprocessors, and memories. Electronic systems include digital, analog, and/or mixed digital and analog circuits. The circuits are often implemented using discrete, integrated, or a combination of discrete and integrated components. To properly operate, many electronic systems utilize one or more voltage and/or current reference generators. In many instances, particularly for analog circuits, more precise circuits utilize more precise reference signals. Thus, in many instances, the reference generators attempt to provide a stable reference signal over variations in supply voltage and temperatures. A bandgap reference represents an accepted choice to supply the reference signal. In general, bandgap references refer to the utilization of a voltage difference between two p-n-junctions operating at different current densities to generate the reference signal.

FIG. 1 depicts a bandgap reference 100, which provides a bandgap reference voltage VBG. In general, the bandgap reference 100 develops the bandgap reference voltage VBG based on the inherent forward-biased voltages across diodes 102 and 104. The bandgap reference 100 receives power from a voltage source having a voltage VCC referenced to a ground reference 101. When forward biased, diodes 102 and 104 have respective forward biased voltages VBE1 and VBE2. Voltage VBE2 is a fraction of voltage VBE1. A desired ratio of voltages VBE2 to VBE1 can be achieved by increasing the size, and, thus, the current density, of diode 104 relative to diode 102 or placing multiple diodes in parallel to collectively from diode 104. Operational amplifier 106 maintains the voltage $V_{NN}$ equal to voltage $V_{NP}$ by driving the gate of p-channel metal oxide semiconductor field effect transistor (PMOSFET) 112 in accordance with the difference voltage of $V_{NN}$-$V_{NP}$. For $V_{NN}>V_{NP}$, current $i_{C2}$ decreases, and for $V_{NN}<V_{NP}$, current $i_{C2}$ increases. The voltage $V_{NP}$ is at the cathode of diode D1. Accordingly, the bandgap reference voltage VBG is derived as follows with "R" being the resistance value of resistors 110 and 111 and "R1" representing the resistance value of resistor 108:

$$VBE2+i_{C2}\cdot R1=VBE1 \quad [1];$$

$$i_{C2}\cdot R1=VBE1-VBE2=\Delta VBE \quad [2];$$

$$\text{Since } V_{NN}=V_{NP}, i_{C1}=i_{C2}, \text{then } i_{C1}\cdot=\Delta VBE/R1 \quad [3];$$

$$i_{C1}\cdot R=V_{NN}-VBG=(\Delta VBE\cdot R)/R1 \quad [4]; \text{ and}$$

$$VBG=VBE1+(\Delta VBE\cdot R)/R1 \quad [5].$$

In at least one embodiment, bulk error currents develop in semiconductor bulk material, especially with changes and increases in the supply voltage VCC. Bulk error currents occur because of, for example, hot electron injection of current in a semiconductor device, such as a metal oxide semiconductor field effect transistor (MOSFET). The bulk error current occurs when, for example, "hot" electrons cross an energy barrier in a channel region of the MOSFET. In a stable environment with an approximately constant bulk error current $i_{BULK_ERROR}$, bandgap reference 100 provides a relatively stable bandgap reference voltage VBG. However, in some environments the direct current (DC) component of supply voltage VCC varies by 100-200% or more, e.g. 6V<VCC<18V, and alternating current (AC) signals, such as transient voltages and ripples, in supply voltage VCC can cause high frequency variations in supply voltage VCC. Variations in the supply voltage VCC tend to vary and, thus, destabilize the bulk error current $i_{BULK_ERROR}$. Variations in the bulk error current $i_{BULK_ERROR}$ destabilize the currents $i_{C1}$ and $i_{C2}$ and, thus, cause the bandgap reference voltage VBG to vary. Variations of the bandgap reference voltage VBG can cause errors in circuits, such as analog-to-digital converters, that rely upon a stable bandgap reference voltage VBG to function properly and accurately.

SUMMARY OF THE INVENTION

In one embodiment of the present invention, an apparatus includes a bandgap reference circuit to generate one or more bandgap reference signals that are substantially invariant to at least changes in direct current values of a supply voltage of the bandgap reference circuit. The apparatus further includes a current mirror, coupled to the bandgap reference circuit, to receive and mirror a control signal. The control signal controls the one or more bandgap reference signals generated by the bandgap reference circuit. The apparatus further includes a proportional to absolute temperature reference signal generator coupled between the bandgap reference circuit and the current mirror to generate one or more proportional to absolute temperature currents from at least one of the bandgap reference signals. The one or more proportional to absolute temperature currents are substantially invariant to at least changes in direct current values of the supply voltage of the bandgap reference circuit.

In another embodiment of the present invention, a method includes generating one or more bandgap reference signals that are substantially invariant to at least changes in direct current values of a supply voltage of the bandgap reference circuit. The method further includes receiving a control signal and mirroring the control signal using a current mirror to control the one or more bandgap reference signals generated by the bandgap reference circuit. The method also includes generating one or more proportional to absolute temperature currents from at least one of the bandgap reference signals. The one or more proportional to absolute temperature currents are substantially invariant to at least changes in direct current values of the supply voltage of the bandgap reference circuit.

In a further embodiment of the present invention, a system includes a bandgap reference circuit to generate one or more bandgap reference signals that are substantially invariant to at least changes in direct current values of a supply voltage of the bandgap reference circuit. The bandgap reference circuit includes first and second parallel current paths, each current path includes one or more diodes, and the total diode forward voltage reduction during operation of the bandgap reference circuit is different for the two paths. The system further includes an operational amplifier having an inverting node coupled to the first parallel current path of the bandgap reference circuit and a non-inverting node coupled to the second parallel current path of the bandgap reference circuit. The operational amplifier is configured to generate a control signal to maintain equal currents through the first and second parallel current paths of the bandgap reference circuit. The system also includes a current mirror, coupled to the bandgap reference circuit, to receive and mirror the control signal. The system further includes a proportional to absolute temperature reference signal generator coupled between the bandgap reference circuit and the current mirror to generate one or more proportional to absolute temperature currents from at least one of the bandgap reference signals. The one or more proportional to absolute temperature currents are substantially invariant to at least changes in direct current values of the supply voltage of the bandgap reference circuit.

BRIEF DESCRIPTION OF THE DRAWINGS

The present invention may be better understood, and its numerous objects, features and advantages made apparent to those skilled in the art by referencing the accompanying drawings. The use of the same reference number throughout the several figures designates a like or similar element.

DETAILED DESCRIPTION

In at least one embodiment, an electronic reference-signal generation system includes a supply invariant bandgap reference system that generates one or more bandgap reference signals that are substantially unaffected by bulk error currents. In at least one embodiment, the bandgap reference generates a substantially invariant bandgap reference signals for a range of direct current (DC) supply voltages. Additionally, in at least one embodiment, the bandgap reference system provides substantially invariant bandgap reference signals when the supply voltage varies due alternating current (AC) voltages. In at least one embodiment, the bandgap reference system generates a bandgap reference voltage VBG, a "proportional to absolute temperature" (PTAT) current ("$i_{PTAT}$") and a "zero dependency on absolute temperature" (ZTAT) current ("$i_{ZTAT}$") that are substantially unaffected by variations in the supply voltage and unaffected by a bulk error current. Thus, in at least one embodiment, the electronic reference-signal generation system provides a stable output voltage, $i_{PTAT}$ current, and $i_{ZTAT}$ current as reference signals for any electronic circuit despite variations in supply voltage and bulk error current.

Figure 1:
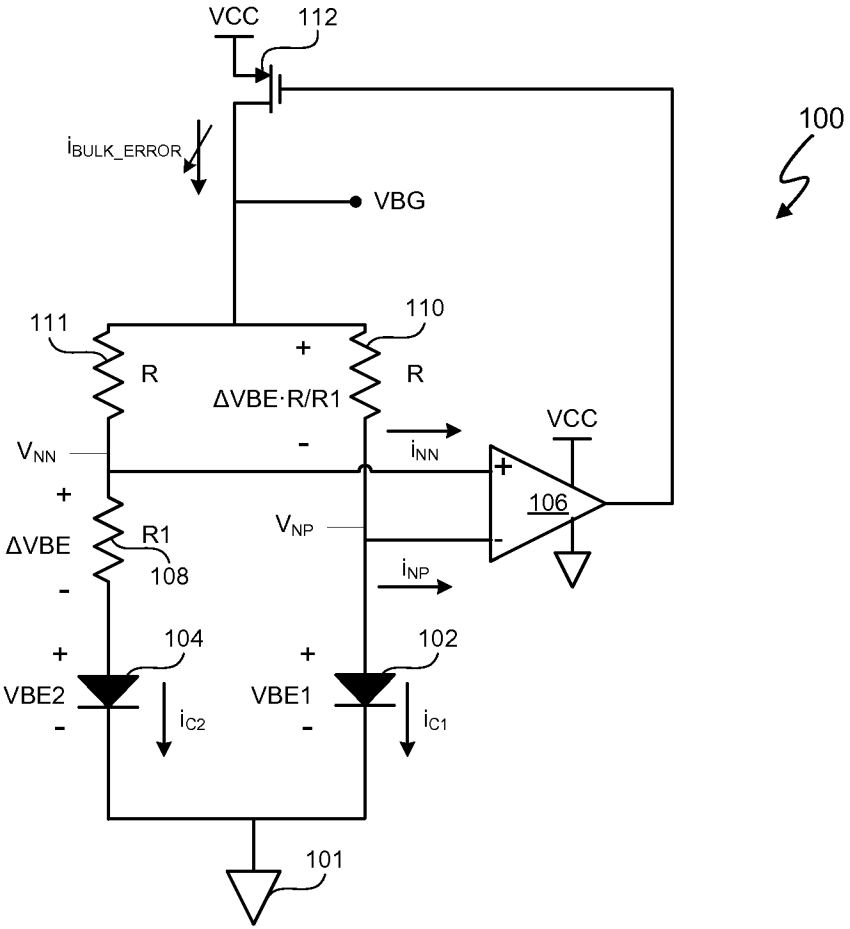
FIG. 1 (PRIOR ART)
FIG. 1 (labeled prior art) depicts a bandgap reference circuit.
Figure 2:
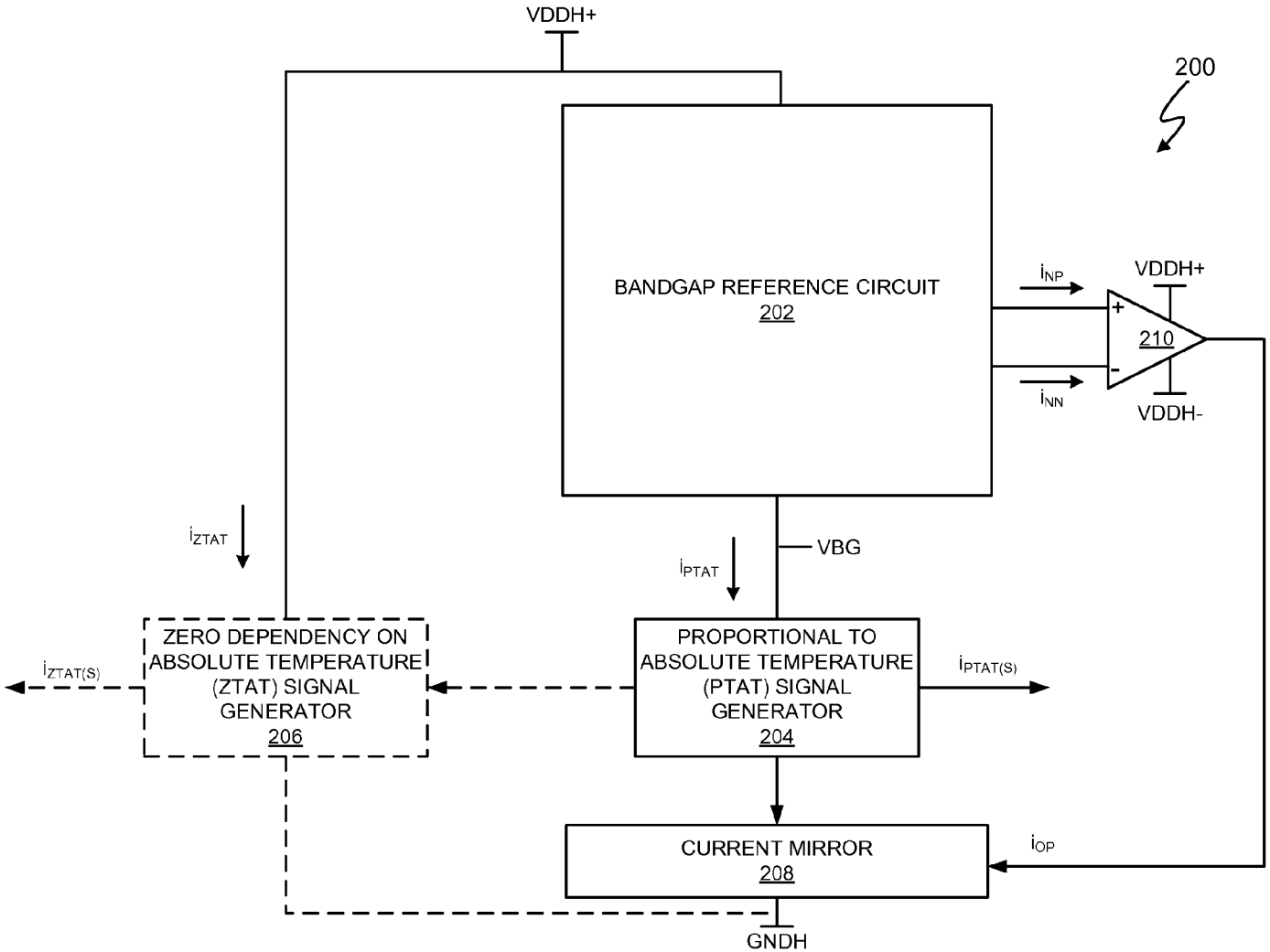
FIG. 2 depicts an electronic reference-signal generation system that includes a supply invariant bandgap reference circuit.

FIG. 2 depicts an electronic reference-signal generation system 200 that includes a supply invariant, bandgap reference circuit 202 to generate a bandgap reference voltage VBG. The electronic reference-signal generation system 200 also includes a proportional to absolute temperature signal generator 204 to generate a supply invariant current $i_{PTAT}$. The electronic reference-signal generation system 200 also optionally (as indicated by dashed lines) includes a zero dependency on absolute temperature signal generator 206 to generate a supply invariant $i_{ZTAT}$ current. The electronic reference-signal generation system 200 also includes a current mirror 208 to assist operational amplifier 210 in maintaining constant reference signals.

In at least one embodiment, the bandgap reference voltage VBG is referenced to the supply voltage VDDH+ rather than the ground reference voltage GNDH to assist in substantially reducing the effects of bulk currents on the values of bandgap reference voltage VBG and currents $i_{PTAT}$ and $i_{ZTAT}$. During operation of electronic reference-signal generation system 200, the $i_{PTAT}$ and $i_{ZTAT}$ currents remain substantially invariant with respect to a range of DC voltage levels of supply voltage VDDH and, in at least one embodiment, and also with respect to AC variations of supply voltage VDDH. The term "substantially" is used because signals can have minor variations that do not affect the use of the bandgap reference voltage VBG or the $i_{PTAT}$ or $i_{ZTAT}$ currents as reference signals. For example, in at least one embodiment, for variations of supply voltage VDDH from 7.5V to 14.5V, the bandgap reference voltage VBG varies by approximately 1 mV. The term "invariant" means substantially no variation. AC variations of supply voltage VDDH are, for example, transient voltages such as a spike, ringing (such as a sin wave superimposed on a DC voltage), and any other periodic or non-periodic perturbations of supply voltage VDDH.

The electronic reference-signal generation system 200 includes an operational amplifier 210 to provide an input current $i_{OP}$ to the current mirror 208. The PTAT signal generator 204, and current mirror 208 provide a feedback path between the operational amplifier 210 and the bandgap reference circuit 202. The operational amplifier 210 drives current mirror 208 to compensate for variations in supply voltage VDDH+ and to compensate for error currents, such as bulk error currents. The current mirror 208 receives and responds to the current $i_{OP}$ from the operational amplifier 210 and drives a current in the current mirror to control the bandgap reference signal current $i_{PTAT}$ and the bandgap reference voltage VBG in the bandgap reference circuit 202. Thus, the current $i_{OP}$ from operational amplifier 210 functions to control the feedback loop through current mirror 208, PTAT signal generator 204, and bandgap reference circuit 202 to maintain the supply invariant bandgap reference voltage VBG and supply invariant current $i_{PTAT}$.

The respective positive and negative voltage rails VDDH+ and VDDH− of operational amplifier 210 float with respect to supply voltage VDDH. In other words, voltage rails VDDH+ and VDDH− change values as supply voltage VDDH changes values so that the difference between VDDH+ and VDDH− is constant. Floating the voltage rails VDDH+ and VDDH− with respect to supply voltage VDDH provides a constant voltage supply for operational amplifier 210, and allows operational amplifier 210 to be substantially unaffected by variations in supply voltage VDDH. In at least one embodiment, variations in supply voltage VDDH+ are the dominant source of bulk error currents.

Figure 3:
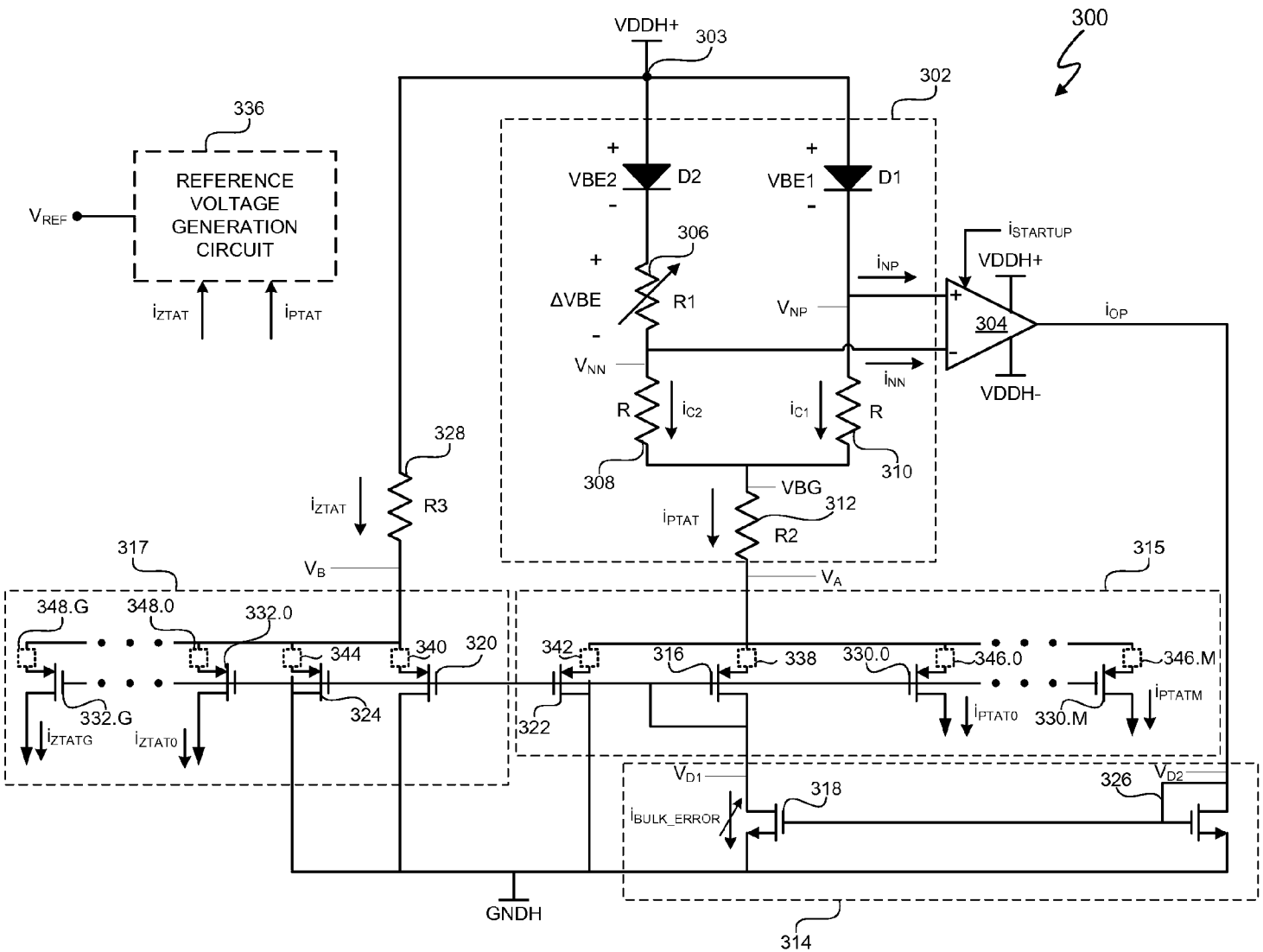
FIG. 3 depicts an embodiment of the electronic reference-signal generation system of FIG. 2.

FIG. 3 depicts an electronic reference-signal generation system 300, which represents one embodiment of the electronic reference-signal generation system 200. The electronic reference-signal generation system 300 includes a bandgap reference circuit 302, which represents one embodiment of bandgap reference circuit 202. The bandgap reference circuit 302 includes a voltage node 303 to receive the supply voltage VDDH+. The bandgap reference circuit 302 includes two, forward-biased diodes D1 and D2. Diodes D1 and D2 have respective forward biased voltages VBE1 and VBE2. Voltage VBE2 is a fraction of voltage VBE1. As subsequently discussed in more detail, a desired ratio of voltages VBE2 to VBE1 can be achieved by increasing the size of diode D2 relative to diode D1 or placing multiple diodes D2 in parallel. Operational amplifier 304 maintains voltage $V_{NN}$ equal to voltage $V_{NP}$. Thus, the voltage across resistor 306 is ΔVBE=VBE1-VBE2. The resistance value of resistor 306 is R1. The particular value R1 of resistor 306 is a matter of design choice. As subsequently described in more detail, the resistance value R1 sets the value of current $i_{PTAT}$. The resistance value R1 is indicated as adjustable because changing the value R1 can change the current $i_{PTAT}$. In at least one embodiment, the resistance value R1 is set using a conventional resistor degeneration network (such as resistor degeneration circuit 600 (FIG. 6)). The bandgap reference circuit 302 also includes resistors 308 and 310, which both have a resistance value R. Because of the symmetry of resistors 308 and 310, current $i_{PTAT}$ equals $2 \cdot i_{C1} = 2 \cdot i_{C2}$. Since current $i_{C2}$=ΔVBE/R1, current $i_{PTAT}$=2·ΔVBE/R1. As subsequently discussed in more detail, the relationship between current $i_{PTAT}$ and ΔVBE and R result in the current $i_{PTAT}$ being supply voltage invariant. A "resistor" can be implemented using any number of series and/or parallel connected resistors.

In at least one embodiment, the voltage rails VDDH+ and VDDH− of operational amplifier 304 float with respect to supply voltage VDDH+ as described in conjunction with operational amplifier 210. In at least one embodiment, operational amplifier 304 is fabricated using low voltage devices. Low voltage devices are generally less susceptible to hot electron injection and associated bulk error currents than high voltage devices. The design of operational amplifier 304 generally determines the DC offset voltage property of operational amplifier 304. Generally, a higher DC voltage offset results in a change in the voltage ΔVBE across resistor R1. To minimize the percentage change of voltage ΔVBE due to the DC offset voltage, the value of voltage ΔVBE can be increased. As previously discussed, the value of voltage ΔVBE is set by the difference between voltages VBE2 and VBE1. Thus, in at least one embodiment, the value of voltage ΔVBE can be increased by increasing the size of diode D2 relative to the size of diode D1.

Figure 4:
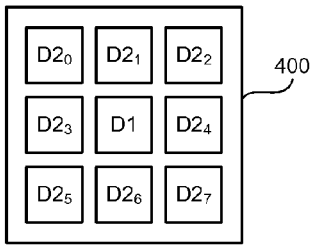
FIG. 4 depicts an exemplary design and arrangement of diodes in the electronic reference-signal generation system of FIG. 3.

The particular design, arrangement, and size ratios of diodes D2 and D1 are matters of design choice. In at least one embodiment, diodes D2 and D1 are designed so that ΔVBE is sufficiently greater than an offset voltage of operational amplifier 304 to allow operational amplifier 304 to equalize the $V_{NN}$ and $V_{NP}$. FIG. 4 depicts an exemplary design and arrangement of diodes D2 and D1 of FIG. 3. Referring to FIGS. 3 and 4, in at least one embodiment, diodes D2 and D1 are arranged as a diode group 402. In diode group 402, diode D2 is actually eight, parallel connected diodes $D2_0$-$D2_7$, and diodes $D2_0$-$D2_7$ are efficiently arranged in a rectangular pattern around central diode D1. Each of diodes $D2_0$-$D2_7$ is the same size as diode D1. The particular area ratio of diodes D2 and D1 is a trade-off between an amount of area occupied by diodes D2 and D1 and accuracy current $i_{PTAT}$. In at least one embodiment, an area ratio of 8:1 is used because the current $i_{PTAT}$ is directly proportional to a natural logarithmic function of the reverse bias currents $i_{S1}$ and $i_{S2}$ of respective diodes D1 and D2. Thus, increases in the size of diode D2 have a subdued effect on the value of current $i_{PTAT}$.

Referring to FIG. 3, as illustrated in the following derivation of current $i_{PTAT}$ for electronic reference-signal generation system 300, the value of current $i_{PTAT}$ is supply voltage invariant:

$$i_{C2} = (VBE1 - VBE2)/R1; \quad [6]$$

$$i_{C2} = \left[V_t \cdot \ln\left(\frac{i_{C1}}{i_{S1}}\right) - V_t \cdot \ln\left(\frac{i_{C2}}{i_{S2}}\right)\right] / R1; \quad [7]$$

$$i_{C2} = \left[V_t \cdot \ln\left(\frac{i_{S2}}{i_{S1}}\right)\right] / R1; \text{ and} \quad [8]$$

$$i_{PTAT} = 2 \cdot \left[V_t \cdot \ln\left(\frac{i_{S2}}{i_{S1}}\right)\right] / R1. \quad [9]$$

"$i_{C1}$" and "$i_{C2}$" are the respective currents through diodes D1 and D2, R1 is the resistance value of resistor 306, $V_t$ is the diode thermal voltage of diodes D1 and D2, "$i_{S1}$" and "$i_{S2}$" are the respective saturation currents of diodes D1 and D2. The ratio $i_{S2}/i_{S1}$ of reverse bias currents $i_{S1}$ and $i_{S2}$ is a constant and is proportional to VBE1-VBE2. Thus, the value of current $i_{PTAT}$ is independent of the supply voltage VDDH+ and also independent of the bulk error current $i_{BULK_ERROR}$.

The electronic reference-signal generation system 300 also optionally includes a supply invariant reference voltage generation circuit 336. The supply invariant reference voltage generation circuit 336 generates a supply invariant reference $V_{REF}$ using the currents $i_{PTAT}$ and $i_{ZTAT}$. An exemplary embodiment of the supply invariant reference voltage generation circuit 336 is subsequently described with reference to FIG. 9.

Figure 5:
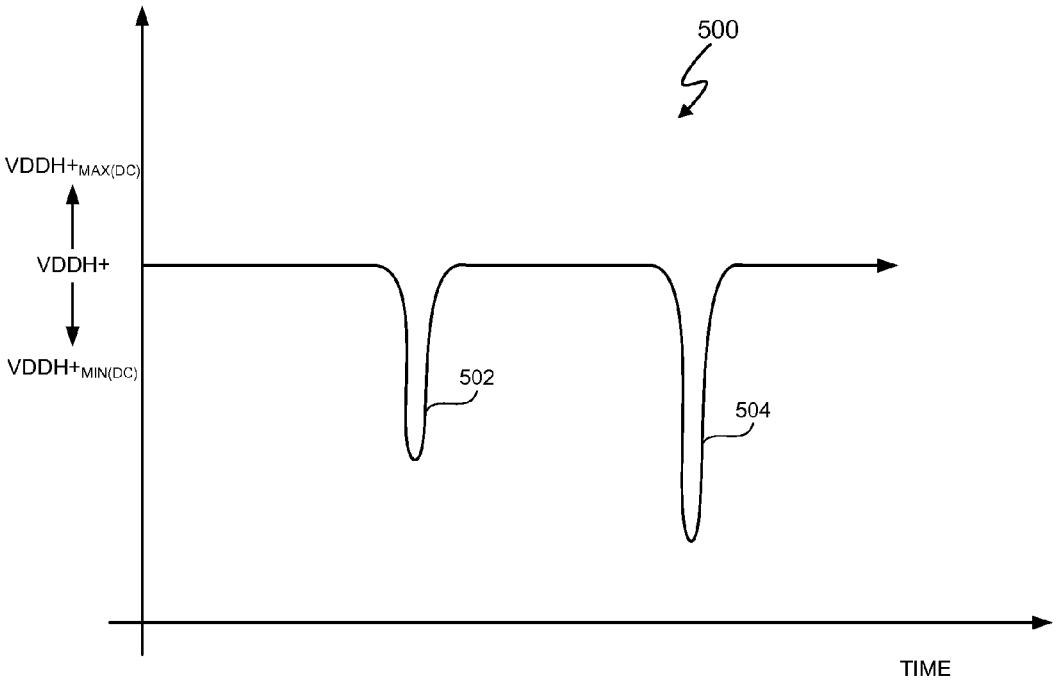
FIG. 5 depicts a voltage-time graph of a time-varying supply voltage in the electronic reference-signal generation system of FIG. 3.

FIG. 5 depicts a voltage-time graph 500 of the supply voltage VDDH+ varying over time. The DC value of supply voltage VDDH+ can vary over time from $VDDH+_{MIN}$ to $VDDH+_{MAX}$. The particular values of $VDDH+_{MIN(DC)}$ and $VDDH+_{MAX(DC)}$ generally depend on factors external to electronic reference-signal generation system 300, such as available supply voltage values from an external power source (not shown). In at least one embodiment, $VDDH+_{MIN(DC)}$ and $VDDH+_{MAX(DC)}$ are respectively 7V and 17.5V. In at least one embodiment, the supply voltage VDDH+ also experiences AC variations, such as high frequency transient voltages 502 and 504, which have a frequency of, for example, 100 MHz. AC components of supply voltage VDDH+ can be caused by any number of factors, such as transient changes in power provided by an external power source (not shown) that supplies power to the electronic reference-signal generation system 300 and ripple voltages due to imperfect voltage rectification. Referring to FIGS. 3 and 5, in accordance with Equation [9], the current $i_{PTAT}$ depends on the thermal voltage $V_t$, resistance value R1, and the saturation currents ratio $i_{S1}/i_{S2}$. Since the thermal voltage $V_t$, the resistance value R1, and the ratio of $i_{S1}/i_{S2}$ are independent of the value of supply voltage VDDH+, current $i_{PTAT}$ is invariant with respect to changes in the supply voltage VDDH+.

Additionally, in at least one embodiment, the current $i_{PTAT}$ and bandgap reference voltage VBG are substantially unaffected by the bulk error current $i_{BULK_ERROR}$. The PTAT signal generator 315 generates PTAT currents $i_{PTAT0}$ through $i_{PTATM}$ directly from the current $i_{PTAT}$ through resistor 312. "M" is an integer index ranging from 0 to the number of current $i_{PTAT}$ copies. The value of M represents a number of copies of $i_{PTAT}$ current to be supplied by the PTAT signal generator 315. "R2" is the resistance value of resistor 312. To generate the PTAT currents $i_{PTAT0}$ through $i_{PTATM}$, the M+1 PMOSFETs 330.0 through 330.M provide M+1 copies of $i_{PTAT}$. MOSFETs 330.0-330.M have common gates connected to the gate of PMOSFET 316. The PMOSFETs 330.0-330.M generate M+1 respective PTAT currents $i_{PTAT0}$ through $i_{PTATM}$. The sum of PTAT currents $i_{PTAT0}$ through $i_{PTATM}$ equals 2·ΔVBE/R1. The sum of the M+1 PTAT currents $i_{PTAT0}$ through $i_{PTATM}$ equals the value of current $i_{PTAT}$, i.e. $i_{PTAT0}+i_{PTAT1}+\ldots i_{PTATM}=i_{PTAT}$. Each of the M+1 currents $i_{PTAT0}$ through $i_{PTATM}$ is referred to as a copy of the current $i_{PTAT}$. If M>0, the currents $i_{PTAT0}$ through $i_{PTATM}$-are scaled copies of current $i_{PTAT}$. The particular values of PTAT currents $i_{PTAT0}$ through $i_{PTATM}$ are also function of the size of respective PMOSFETs 330.0 through 330.M. In at least one embodiment, because PMOSFETs are less susceptible to bulk error currents, using PMOSTFETs in PTAT signal generator 315 allows the currents $i_{PTAT0}$ through $i_{PTATM}$ to be substantially unaffected by bulk error currents. Additionally, in at least one embodiment, the connection of the gates of PMOSFETs 330.0-330.M to the gate of PMOSFET 316 to form a current replicator allows all the PTAT currents $i_{PTAT0}$ through $i_{PTATM}$ to be substantially unaffected by bulk error currents. In at least one embodiment, PTAT signal generator 315 generates the M+1 copies of current $i_{PTAT}$ for use by any other circuits, such as analog-to-digital converters, digital-to-analog converters, and comparators (not shown), that utilize a current that is "proportional to absolute temperature".

The current mirror 314 includes a diode connected NMOSFET 326, and a gate of the NMOSFET 326 connects to the gate of NMOSFET 318. In at least one embodiment, the bulk current $i_{BULK_ERROR}$ derives from differences between the drain voltages $V_{D1}$ and $V_{D2}$, which are affected by variations in supply voltage VDDH+, of respective NMOSFETs 318 and 326. The current mirror 314 represents one embodiment of current mirror 208. NMOSFET 318 is configured as a source follower having a source terminal connected to the source of diode connected to PMOSFET 316 of PTAT signal generator 315. The output current $i_{OP}$ of operational amplifier 304 drives the gate of NMOSFET 318. Any bulk error current $i_{BULK_ERROR}$ will change the value of current $i_{PTAT}$ and, thus, the values of currents $i_{C1}$ and $i_{C2}$. When the value of current $i_{C2}$ changes, voltage $V_{NN}$ changes with respect to voltage $V_{NP}$. Operational amplifier 304 includes transconductance circuitry to convert the difference between voltages $V_{NN}$ and $V_{NP}$ into current $i_{OP}$. Current mirror 314 mirrors the current $i_{OP}$ so that the current $i_{OP}$ controls the current $i_{PTAT}$ in the bandgap reference circuit 302. The operational amplifier 304 generates current $i_{OP}$ to modulate the value of current $i_{PTAT}$ to equalize the voltages $V_{NN}$ and $V_{NP}$. Equalizing the voltages $V_{NN}$ and $V_{NP}$ ensures that current $i_{PTAT}$ remains equal to 2·ΔVBE/R1, and, thus, current $i_{PTAT}$ remains unaffected by bulk error current $i_{BULK_ERROR}$.

The electronic reference-signal generation system 300 also generates a voltage supply invariant current $i_{ZTAT}$. In at least one embodiment, to achieve a voltage supply invariant current $i_{ZTAT}$, one or more circuit parameters of electronic reference-signal generation system 300 are adjusted so that d(VDDH+−$V_B$)/dT=dR3/dT, i.e. the change of voltage VDDH+minus voltage $V_B$ with respect to a change in temperature equals the change in resistance value R3 with respect to temperature. In at least one embodiment, PMOSFETs 316, 320, 322, and 324 and diode-connected NMOSFETs 316 and 326 are biased to operate in the saturation region. In at least one embodiment, PMOSFETs 316, 320, 322, and 324 are biased to operate in the sub-threshold region. Because PMOSFETs 322 and 324 have a common gate, bulk current error correction circuit 314 maintains voltage $V_A$ at the source of PMOSFET 322 equal to voltage $V_B$ at the source of PMOSFET 324. Accordingly, current $i_{ZTAT}$ is referenced to the supply voltage VDDH+, and $i_{ZTAT}$=(VDDH+−$V_B$)/R3. "R3" is the resistance value of resistor 328.

The voltage $V_B$ has a non-zero temperature coefficient with respect to the supply voltage VDDH+, i.e. VDDH+−$V_B$ varies with temperature. A "temperature coefficient" is a factor by which a value changes as temperature changes. The "temperature coefficient" is generally represented herein as "dX/dT", where dX is the value change of X over for a temperature change of dT. However, the temperature coefficient dR3/dT of resistor 328 is proportional to the temperature coefficient $dV_B$/dT of voltage $V_A$. In general, dR3/dT can be positive, negative, or zero. The temperature coefficient of voltage $V_A$ is set so that d(VDDH+−$V_B$)/dT equals dR3/dT. In at least one embodiment, the voltages $V_A$ and $V_B$ are generated so that $di_{ZTAT}$/dT=0.

Voltage $V_A$=VBE1+K·ΔVBE and, thus, $dV_A$/dT=dVBE1/dT+K·dΔVBE/dT. In terms of temperature coefficients K·dΔVBE/dT is a positive temperature coefficient and dVBE1/dT is a negative temperature coefficient. In at least one embodiment, "K" is a ratio of resistance values and is, for example, K=(R2+2R)/R1. The value of dVBE1/dT and dΔVBE/dT are functions of the respective properties of diode D1 and diodes D1 and D2 and are, thus, fixed. Accordingly, the resistance values R, R1, and R2 can be set so that $dV_B$/dT=dR3/dT and, thus, make current $i_{ZTAT}$ temperature invariant. Accordingly, setting the values of R, R1, and R2 so that:

$$\frac{dR3}{dT}=\frac{dV_A}{dT}=\frac{dVBE1}{dT}+\frac{R2+2R}{R1}\cdot\frac{d\Delta VBE}{dT}+\frac{d\Delta Vgs}{dT}. \quad [10]$$

"ΔVgs" represents the difference between the gate voltages Vgs320 and Vgs316 of respective PMOSFETs 320 and 316, i.e. ΔVgs=Vgs320−Vgs316.

In at least one embodiment, ZTAT signal generator 317 generates G+1 copies of currents $i_{ZTAT}$ for use by any other circuits, such as analog-to-digital converters, digital-to-analog converters, and comparators (not shown), that utilize a current that has "zero dependency on absolute temperature" ($i_{ZTAT}$). "G" is an integer index ranging from 0 to the number plus one of current $i_{ZTAT}$ copies. The G+1 PMOSFETs 332.0 through 332.G provide G+1 copies of $i_{ZTAT}$. MOSFETs 332.0-332.G have common gates connected to the gate of PMOSFET 324. The PMOSFETs 332.0-332.G generate G+1 respective $i_{ZTAT}$ currents: $i_{ZTAT0}$ through $i_{ZTATG}$. Because of the connection of the gates of PMOSFETs 332.0-332.G to the gate of PMOSFET 324, the currents $i_{ZTAT0}$ through $i_{ZTATG}$ are also substantially unaffected by bulk error currents.

In at least one embodiment, electronic reference-signal generation system 300 includes one or more of respective variable resistance circuits 338, 340, 342, 344, 346.0-346.M, and 348.0-348.M. In at least one embodiment, each included variable resistance circuits 338, 340, 342, 344, 346.0-346.M, and 348.0-348.G is connected to a respective source of PMOSFETs 316, 320, 322, 324, 330.0-330.M, and 332.0-332.G. In at least one embodiment, the resistance of each included variable resistance circuits 338, 340, 342, 344, 346.0-346.M, and 348.0-348.G is set to match the voltage and current characteristics of respective PMOSFETs 316, 320, 322, 324, 330.0-330.M, and 332.0-332.G.

Figure 6:
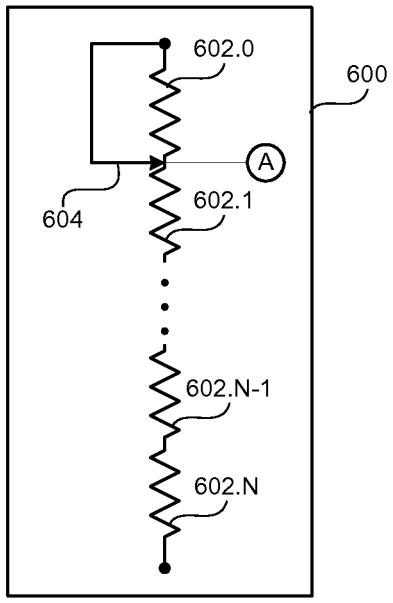
FIG. 6 depicts an exemplary resistor degeneration circuit.

FIG. 6 depicts an exemplary resistor degeneration circuit 600 and represents one embodiment of variable resistance circuits 338, 340, 342, 344, 346.0-346.M, and 348.0-348.G.

Resistor degeneration can be used in electronic reference-signal generation system 300 to set resistance values and to improve effective matching of properties of MOSFETs. For example, resistor degeneration can be used to match the voltage and current characteristics of respective PMOSFETs 316, 320, 322, 324, 330.0-330.M, and 332.0-332.M, accurately set ΔVBE, set the resistance value R1 of resistor 306, and so on. Resistor degeneration circuit 600 includes N+1 resistors 602.0-602.N, where "N" is an integer index greater than or equal to 1. In at least one embodiment, the value of N and, thus, the number N+1 of resistors 602.0-602.N equals the number of PMOSFETs 330.0-330.M and 332.0-332.G. The tap 604 can be set at any point, such as point A, to set the resistance value of the resistor degeneration circuit 600. In the exemplary embodiment of FIG. 600, the resistance value of resistor degeneration circuit 600 equals the sum of the resistance values of resistors 602.1 through 602.N. The number of resistors and values of the resistors in resistor degeneration circuit 600 is a matter of design choice. In general, increasing the number of resistors provides a wider range of resistances and/or finer gradations in resistance.

Referring to FIG. 3, in at least one embodiment, a startup current $i_{STARTUP}$ is used by electronic reference-signal generation system 300 to enter a predictable steady state operation where operational amplifier 304 maintains voltage $V_{NN}$ equal to $V_{NP}$ and current $i_{PTAT}$ is not equal to zero. Because the startup current $i_{STARTUP}$ can be affected by, for example, supply voltage VDDH+ and temperature changes, in at least one embodiment, the startup current $i_{STARTUP}$ is a small percentage of the current $i_{PTAT}$. For example, in at least one embodiment, $i_{STARTUP} \leqq 0.01 \cdot i_{PTAT}$.

Figure 7:
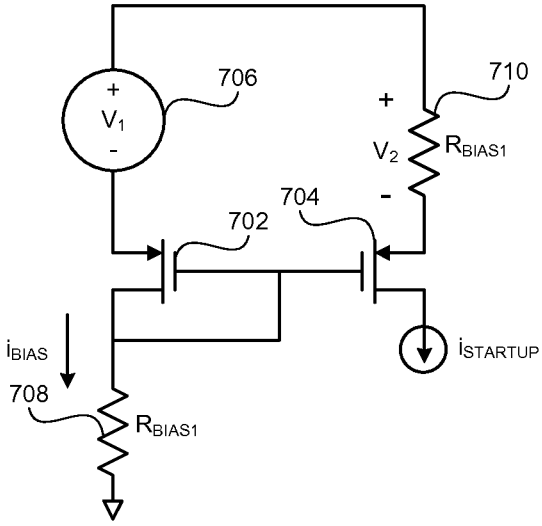
FIG. 7 depicts an exemplary startup current generator.

FIG. 7 depicts an exemplary startup current generator 700 to generate the startup current $i_{STARTUP}$. The startup current generator 700 utilizes a current mirror that includes diode-connected PMOSFET 702 having a common gate with PMOSFET 704. DC voltage source 706 provides a reference voltage $V_1$, and resistor 708, having a resistance value of $R_{BIAS1}$, establishes a bias current. If PMOSFETs 702 and 704 are identical, the voltage $V_2$ across bias resistor 710 equals the reference voltage $V_1$. Therefore, the startup current $i_{STARTUP}$ equals $V_2/R_{BIAS1}$. In at least one embodiment, the voltage $V_1$ is generated by a forward biased voltage drop across a diode or diode connected transistor. Because voltage $V_1$ is independent of supply voltage VDDH+ and $V_2/R_{BIAS1}$ equals $V_1$, the current $i_{STARTUP}$ is also independent of supply voltage VDDH+.

Figure 8:
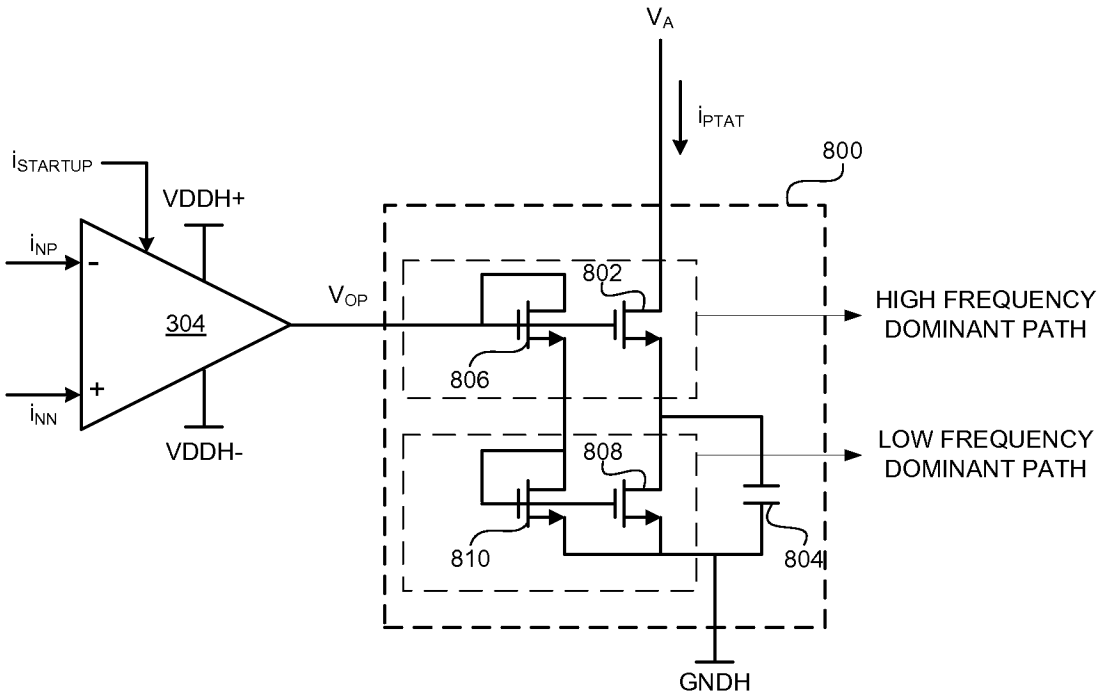
FIG. 8 depicts an embodiment of an alternating current (AC) compensation circuit.

FIG. 8 depicts an embodiment of a transient compensation circuit 800 that responds to AC transients, such as transients 502 and 504 of supply voltage VDDH+ of FIG. 5, to maintain a supply invariant current $i_{PTAT}$. Referring to FIGS. 3 and 8, in at least one embodiment, the transient compensation circuit 800 replaces NMOSFET 318 in bulk current error correction circuit 314. The transient compensation circuit 800 includes a high frequency dominant path through NMOSFET 802 and capacitor 804. Diode-connected NMOSFET 806 has a common gate with NMOSFET 802, and the gate is driven by the output voltage $V_{OP}$ of operational amplifier 304. NMOSFET 806 biases NMOSFET 802 in the saturation region. When supply voltage VDDH+ experiences a high frequency transient, the voltage $V_A$ and $V_B$ (FIG. 3) and current $i_{PTAT}$ can also change in response to the transient. Capacitor 804 shunts the drain of NMOSFET 804 to ground GNDH and, thus, any high frequency components of current $i_{PTAT}$ are also shunted to ground. NMOSFET 802 has a faster reaction time than NMOSFET 808 and NMOSFET 810. Thus, bypassing NMOSFET 808 allows operational amplifier 304 to recover equality between voltages $V_A$ and $V_B$ more quickly. Thus, the current path established by NMOSFETs 802 and 806 is referred to as a "high frequency dominant path". Diode-connected NMOSFET 810 biases NMOSFET 808 in the saturation region. For low frequency values of current $i_{PTAT}$, NMOSFET 808 dominates the current path of current $i_{PTAT}$. Thus, the current path established by NMOSFETs 808 and 810 is referred to as a "low frequency dominant path".

Figure 9:
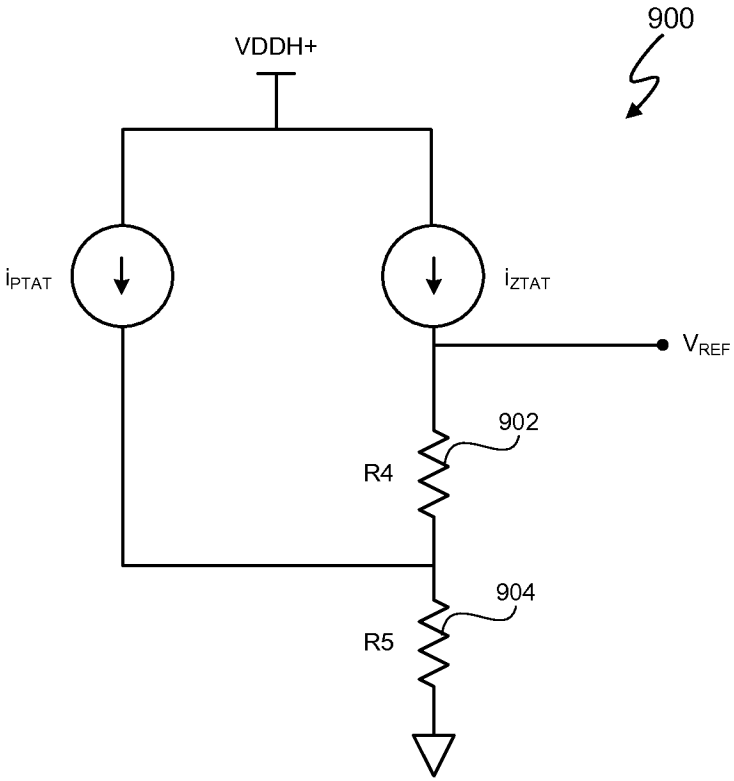
FIG. 9 depicts a supply invariant reference voltage generation circuit.

FIG. 9 depicts a supply invariant reference voltage generation circuit 900. As previously discussed, currents $i_{PTAT}$ and $i_{ZTAT}$ are supply invariant. The supply invariant bandgap reference voltage generation circuit 900 combines currents $i_{PTAT}$ and $i_{ZTAT}$ through a resistor divider network to generate a supply invariant reference voltage $V_{REF}$. The resistor divider has two resistors 902 and 904 having respective resistance value of R4 and R5. From Equations [11]-[17], the values of R4 and R5 can be set so that the reference voltage $V_{REF}$ has a zero dependency on absolute temperature:

$$V_{REF}=(R4+R5)\cdot i_{ZTAT}+R5\cdot i_{PTAT} \quad [11];$$

$$V_{REF}=V_{ZTAT}+J\cdot V_{PTAT} \quad [12];$$

$$dV_{REF}/dT=dV_{ZTAT}/dT+J\cdot dV_{PTAT}/dT \quad [13];$$

$$dV_{ZTAT}/dT \alpha d(R4+R5)/dT \quad [14];$$

$$J\cdot V_{PTAT}=[d(R4+R5)/dT]\cdot i_{ZTAT}; \quad [15]$$

$$V_{PTAT}=R5\cdot i_{PTAT}; \text{ and} \quad [16]; \text{ and}$$

$$J=[d(R4+R5)/dT\cdot i_{ZTAT}]/(R5\cdot i_{PTAT}) \quad [17].$$

"$V_{ZTAT}$" equals (R4+R5)·$i_{ZTAT}$, "α" is a proportionality symbol, and "$V_{PTAT}$" equals R5·$i_{PTAT}$. The values of the temperature coefficients $dV_{ZTAT}/dT$ and $dV_{PTAT}/dT$ are a function of device parameters. In at least one embodiment, the values R4 and R5 are set so that $dV_{REF}$ In at least one embodiment, $dV_{ZTAT}/dT$ equals −734 ppm/° C. and $dV_{PTAT}/dT$ equals (4129−724) ppm/° C. To set the reference voltage temperature coefficient equal to zero, $dV_{REF}/dT=dV_{ZTAT}/dT+J\cdot dV_{PTAT}/dT=0$, so J=0.216. Thus, in accordance with Equation [17], for a 1.216V reference voltage $V_{REF}$, the resistance values R4 and R5 are set so that $V_{ZTAT}$=1 V and $V_{PTAT}$ equals 0.216 V.

Thus, an electronic reference-signal generation system generates a supply invariant bandgap reference voltage and currents $i_{PTAT}$ and $i_{ZTAT}$. Additionally, the electronic reference-signal generation system includes bulk current error correction to compensate for bulk error currents.

Although embodiments have been described in detail, it should be understood that various changes, substitutions, and alterations can be made hereto without departing from the spirit and scope of the invention as defined by the appended claims.

What is claimed is:

1. An apparatus comprising:

a bandgap reference circuit to generate one or more bandgap reference signals that are substantially invariant to at least changes in direct current values of a supply voltage of the bandgap reference circuit;

a current mirror, coupled to the bandgap reference circuit, to receive and mirror a control signal, wherein the control signal controls the one or more bandgap reference signals generated by the bandgap reference circuit; and a proportional to absolute temperature reference signal generator coupled between the bandgap reference circuit and the current mirror to generate one or more proportional to absolute temperature currents from at least one of the bandgap reference signals, wherein the one or more proportional to absolute temperature currents are substantially invariant to at least changes in direct current values of the supply voltage of the bandgap reference circuit, and, during operation of the current mirror, bulk error currents exist in the current mirror and each proportional to absolute temperature current is substantially invariant to the bulk error currents in the current mirror.

2. The apparatus of claim 1 wherein the current mirror comprises n-channel transistors to generate a mirror of the control signal, and the proportional to absolute temperature reference signal generator comprises p-channel transistors to generate one or more proportional to absolute temperature currents.

3. The apparatus of claim 1 wherein the bandgap reference signals are substantially invariant to transients of the supply voltage.

4. The apparatus of claim 1 wherein the bandgap reference signals include a reference voltage that is substantially invariant to at least changes in direct current values of a supply voltage of the bandgap reference circuit.

5. The apparatus of claim 1 further comprising:

an operational amplifier coupled between the bandgap reference circuit and the current mirror, wherein, during operation of the apparatus, the operational amplifier responds to changes in voltages in the bandgap reference circuit and drives a current in the current mirror to maintain the one or more bandgap reference signals.

6. The apparatus of claim 5 wherein the operational amplifier includes a low frequency dominant path and a high frequency dominant path to respectively respond to alternating current and direct current changes in the voltages of the bandgap reference circuit.

7. The apparatus of claim 5 wherein the current mirror includes a source-follower field effect transistor having a gate coupled to the operational amplifier, a drain coupled to the bandgap reference circuit, and a source coupled to a reference voltage, wherein the operational amplifier drives a gate voltage of the field effect transistor to compensate for at least bulk error currents.

8. The apparatus of claim 5 wherein the operational amplifier is coupled to two voltage rails, and the two voltage rails float with respect to the supply voltage.

9. The apparatus of claim 1 wherein one of the bandgap reference signals is a proportional to absolute temperature current and the proportional to absolute temperature reference signal generator generates copies of the proportional to absolute temperature current generated by the bandgap reference circuit.

10. The apparatus of claim 1 wherein the apparatus is further configured to generate a zero dependency on absolute temperature current that is invariant to at least changes in direct current values of a supply voltage of the bandgap reference circuit.

11. The apparatus of claim 10 further comprising:

a zero dependency on absolute temperature generator to generate at least one copy of the zero dependency on absolute temperature current, wherein the copy of the zero dependency on absolute temperature current is invariant to at least changes in direct current values of a supply voltage of the bandgap reference circuit.

12. The apparatus of claim 1 wherein the bandgap reference circuit is referenced to the supply voltage.

13. The apparatus of claim 1 wherein the bandgap reference circuit comprises two semiconductor devices configured as diodes and an anode of each of the two semiconductor devices are forward biased from a floating supply voltage rail.

14. The apparatus of claim 13 wherein the two semiconductor devices each comprise a diode.

15. A method comprising:

generating one or more bandgap reference signals that are substantially invariant to at least changes in direct current values of a supply voltage of the bandgap reference circuit;

receiving a control signal;

mirroring the control signal using a current mirror to control the one or more bandgap reference signals generated by the bandgap reference circuit; and generating one or more proportional to absolute temperature currents from at least one of the bandgap reference signals, wherein the one or more proportional to absolute temperature currents are substantially invariant to at least changes in direct current values of the supply voltage of the bandgap reference circuit and, when mirroring the control signal using a current mirror, bulk error currents exist in the current mirror and each proportional to absolute temperature current is substantially invariant to the bulk error currents in the current mirror.

16. The method of claim 15 wherein generating the one or more bandgap reference signals further comprises generating one or more bandgap reference signals to be substantially invariant to transients of the supply voltage.

17. The method of claim 15 further comprising:

generating one or more zero dependency on absolute temperature currents that are substantially invariant to at least changes in direct current values of the supply voltage of the bandgap reference circuit.

18. The method of claim 15 further comprising:

generating a control signal to respond to changes in voltages in the bandgap reference circuit and drive a current in the current mirror to maintain substantial invariance of the one or more bandgap reference signals to at least changes in direct current values of a supply voltage of the bandgap reference circuit.

19. The method of claim 18 wherein generating a control signal to respond to changes in voltages in the bandgap reference circuit further comprises:

generating the control signal using a high frequency dominant path to respond to alternating current voltage changes in the voltages of the bandgap reference circuit; and generating the control signal using a low frequency dominant path to respond to direct current voltage changes in the voltages of the bandgap reference circuit.

20. The method of claim 18 wherein the current mirror includes a source-follower field effect transistor having a gate coupled to an operational amplifier, a drain coupled to the bandgap reference circuit, and a source coupled to a reference voltage, wherein the operational amplifier drives a gate voltage of the field effect transistor to compensate for at least bulk error currents.

21. The method of claim 15 wherein one of the bandgap reference signals is a proportional to absolute temperature current and generating one or more proportional to absolute temperature currents from at least one of the bandgap reference signals further comprises generating copies of the proportional to absolute temperature current generated by the bandgap reference circuit.

22. The method of claim 15 further comprising:

generating a zero dependency on absolute temperature current that is substantially invariant to at least changes in direct current values of the supply voltage of the bandgap reference circuit.

23. The method of claim 22 further comprising:

generating a zero dependency on absolute temperature current that is substantially invariant to at least changes in direct current values of the supply voltage of the bandgap reference circuit and bulk error currents.

24. The method of claim 15 further comprising:

referencing the bandgap reference circuit to the supply voltage.

25. The method of claim 15 wherein the bandgap reference circuit comprises two semiconductor devices configured as diodes and an anode of each of the two semiconductor devices, and the method further comprises:

forward biasing the two semiconductor devices using a floating supply voltage rail.

26. The method of claim 25 wherein the two semiconductor devices each comprise a diode.

27. The method of claim 15 further comprising:

generating an output signal from an operational amplifier, coupled between the bandgap reference circuit and the current mirror, wherein the output signal responds to changes in voltages in the bandgap reference circuit and drives a current in the current mirror to maintain the supply invariant bandgap reference voltage; and providing two voltage rails to the operational amplifier, wherein the two voltage rails float with respect to the supply voltage.

28. A system comprising:

a bandgap reference circuit to generate one or more bandgap reference signals that are substantially invariant to at least changes in direct current values of a supply voltage of the bandgap reference circuit, wherein the bandgap reference circuit includes first and second parallel current paths, each current path includes one or more diodes, and the total diode forward voltage reduction during operation of the bandgap reference circuit is different for the two paths;

an operational amplifier having an inverting node coupled to the first parallel current path of the bandgap reference circuit and a non-inverting node coupled to the second parallel current path of the bandgap reference circuit, wherein the operational amplifier is configured to generate a control signal to maintain equal currents through the first and second parallel current paths of the bandgap reference circuit;

a current mirror, coupled to the bandgap reference circuit, to receive and mirror the control signal; and a proportional to absolute temperature reference signal generator coupled between the bandgap reference circuit and the current mirror to generate one or more proportional to absolute temperature currents from at least one of the bandgap reference signals, wherein the one or more proportional to absolute temperature currents are substantially invariant to at least changes in direct current values of the supply voltage of the bandgap reference circuit, and, during operation of the current mirror, bulk error currents exist in the current mirror and each proportional to absolute temperature current is substantially invariant to the bulk error currents in the current mirror.

29. The apparatus of claim 28 wherein the apparatus is further configured to generate a zero dependency on absolute temperature current that is invariant to at least changes in direct current values of a supply voltage of the bandgap reference circuit.

30. The system of claim 28 wherein the bandgap reference circuit comprises two semiconductor devices configured as diodes and an anode of each of the two semiconductor devices are forward biased from a floating supply voltage rail.

31. The system of claim 30 wherein the two semiconductor devices each comprise a diode.

32. The system of claim 30 wherein the operational amplifier is coupled to two voltage rails, and the two voltage rails float with respect to the supply voltage.

* * * * *